US010074312B2

(12) United States Patent
Yoon et al.

(10) Patent No.: US 10,074,312 B2
(45) Date of Patent: Sep. 11, 2018

(54) DISPLAY DEVICE INCLUDING TWO SCAN LINES FOR SAME PIXEL

(71) Applicant: Samsung Display Co., Ltd., Yongin-si, Gyeonggi-do (KR)

(72) Inventors: Soowan Yoon, Yongin-si (KR); Taejin Kim, Yongin-si (KR); Myungho Lee, Yongin-si (KR); Heesoon Jeong, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 15/232,556

(22) Filed: Aug. 9, 2016

(65) Prior Publication Data

US 2017/0047011 A1 Feb. 16, 2017

(30) Foreign Application Priority Data

Aug. 10, 2015 (KR) ..... 10-2015-0112722

(51) Int. Cl.
*G09G 3/30* (2006.01)
*G09G 3/3258* (2016.01)

(52) U.S. Cl.
CPC ... *G09G 3/3258* (2013.01); *G09G 2300/0465* (2013.01); *G09G 2310/0202* (2013.01)

(58) Field of Classification Search
USPC ..... 345/76–82
See application file for complete search history.

(56) References Cited

U.S. PATENT DOCUMENTS

| | | | | |
|---|---|---|---|---|
| 7,420,550 | B2 * | 9/2008 | Yuh-Ren | G09G 3/3659 345/103 |
| 8,674,905 | B2 * | 3/2014 | Eom | G09G 3/3233 345/76 |
| 2005/0110718 | A1 * | 5/2005 | Lee | G09G 3/3241 345/76 |
| 2005/0264496 | A1 | 12/2005 | Shin | |
| 2007/0001938 | A1 * | 1/2007 | Lee | G09G 3/3225 345/76 |
| 2011/0074757 | A1 * | 3/2011 | Chung | G09G 3/3233 345/211 |
| 2011/0193830 | A1 | 8/2011 | Cho | |

FOREIGN PATENT DOCUMENTS

| | | |
|---|---|---|
| KR | 10-2005-0112838 A | 12/2005 |
| KR | 10-2011-0091369 A | 8/2011 |
| KR | 10-2014-0140305 A | 12/2014 |

* cited by examiner

*Primary Examiner* — Roy P Rabindranath
(74) *Attorney, Agent, or Firm* — Knobbe, Martens, Olson & Bear, LLP

(57) ABSTRACT

A display device is disclosed. In one aspect, the display device includes a first pixel disposed in an odd numbered pixel column and in a first pixel row, a second pixel disposed in an even numbered pixel column and in the first pixel row and a data line disposed between the odd and even numbered pixel columns and configured to apply a plurality of data voltages to the first and second pixels. The display device also includes a first odd number scan line configured to transmit a first odd number scan signal to the first pixel during a first data writing period, a first even number scan line configured to transmit a first even number scan signal to the second pixel during a second data writing period, and a second scan line configured to transmit a second scan signal to the first and second pixels during an initialization period.

17 Claims, 7 Drawing Sheets

DISPLAY DEVICE INCLUDING TWO SCAN LINES FOR SAME PIXEL

INCORPORATION BY REFERENCE TO ANY PRIORITY APPLICATIONS

This application claims the benefit of Korean Patent Application No. 10-2015-0112722, filed on Aug. 10, 2015, in the Korean Intellectual Property Office, the disclosure of which is incorporated herein in its entirety by reference.

BACKGROUND

Field

The described technology generally relates to a display device.

Description of the Related Technology

In general, a display device emits light of various colors by combinations of brightness of a pixel ("R") emitting red light, a pixel ("G") emitting green light, and a pixel ("B") emitting blue light. Generally, the R pixel, the G pixel, and the B pixel are consecutively located in a row direction and a data line is connected to each of the pixels (multiple rows of R/G/B pixels form a matrix to display images.).

A data driver has to simultaneously apply data signals to all data lines. Thus, the data driver has to have output terminals corresponding to the number of data lines. However, in general, since multiple integrated circuits are used to manufacture the data driver, the number of output terminals that one integrated circuit has is limited. Therefore, many integrated circuits have to be used in order to drive all the data lines. In addition, when a data line for each pixel is formed and a driving device for driving such a pixel is also formed in a limited display area, the so-called aperture ratio of the pixel decreases and the manufacturing costs of the display device increase.

SUMMARY OF CERTAIN INVENTIVE ASPECTS

One inventive aspect relates to a display device having an increased aperture ratio of pixels and decreased manufacturing costs and a method of driving the display device.

Another aspect is a display device that includes a first pixel disposed in an odd numbered pixel column and in a first pixel row, a second pixel disposed in an even numbered pixel column and in the first pixel row, a data line disposed between the odd numbered pixel column and the even numbered pixel column and configured to apply data voltages to the first pixel and the second pixel, a first odd number scan line configured to transmit a first odd number scan signal to the first pixel during a first data writing period, a first even number scan line configured to transmit a first even number scan signal to the second pixel during a second data writing period, and a second scan line configured to transmit a second scan signal to the first pixel and the second pixel during an initialization period.

The first odd number scan signal and the first even number scan signal may be transmitted sequentially.

The first pixel and the second pixel may be symmetrical with respect to the data line.

The device may further include an emission control line configured to transmit emission control signals to the first pixel and the second pixel.

At least two emission control lines disposed in at least two pixel rows may be connected to each other and may be configured to transmit same emission control signal to pixels disposed in the at least two pixel rows.

The first odd number scan signal may be transmitted from the first odd number scan line corresponding to the first pixel row in which the first pixel and the second pixel are disposed, the first even number scan signal may be transmitted from the first even number scan line corresponding to the first pixel row, and the second scan signal may be transmitted from the second scan line corresponding to a second pixel row prior to the first pixel row.

The first data writing period and the second data writing period may sequentially follow the initialization period, and at least portions of the first data writing period and the second data writing period may overlap each other.

Each of the first pixel and the second pixel may include: an organic light-emitting diode; a second transistor including a gate electrode connected to the first odd number scan line or the first even number scan line, a first electrode connected to the data line, and a second electrode connected to a first node; a capacitor connected between a first power voltage line and a second node; a first transistor including a gate electrode connected to the second node, a first electrode connected to the first node, and a second electrode connected to a third node; a third transistor including a gate electrode connected to the first odd number scan line or the first even number scan line, a first electrode connected to the third node, and a second electrode connected to the second node; a fourth transistor including a gate electrode connected to the second scan line, a first electrode connected to an initialization voltage line, and a second electrode connected to the second node; a fifth transistor including a gate electrode connected to an emission control line, a first electrode connected to the first power voltage line, and a second electrode connected to the first node; a sixth transistor including a gate electrode connected to the emission control line, a first electrode connected to the third node, and a second electrode connected to an anode of the organic light-emitting diode; and a seventh transistor including a gate electrode connected to the second scan line, a first electrode connected to the initialization voltage line, and a second electrode connected to the anode of the organic light-emitting diode.

When the second scan signal is a gate-on voltage, the fourth transistor and the seventh transistor may be turned on and may apply an initialization voltage to at least one of the gate electrode of the first transistor and the anode of the organic light-emitting diode.

When the first odd number scan signal or the first even number scan signal is a gate-on voltage, the second transistor and the third transistor may be turned on and may apply a compensated voltage as much as a threshold voltage of the first transistor with respect to the data voltage to the gate electrode of the first transistor and both ends of the capacitor.

At least portions of a first data writing period for which the first odd number scan signal is a gate-on voltage and a second writing period for which the first even number scan signal is a gate-on voltage may overlap each other.

The device may further include an emission control line configured to transmit emission control signals to the first pixel and the second pixel, wherein, when the emission control signal is a gate-on voltage, the fifth transistor and the sixth transistor may be turned on so that a current corresponding to a voltage difference between a voltage applied to the gate electrode of the first transistor and a first power voltage may be supplied to the organic light-emitting diode.

At least two emission control lines disposed in at least two pixel rows may be connected to each other and may be configured to transmit same emission control signal to pixels disposed in the at least two pixel rows.

Another aspect is a display device that includes a first pixel disposed in a first pixel column and in a first pixel row, a second pixel disposed in a second pixel column adjacent to the first pixel column and in the first pixel row, a data line disposed between the first pixel and the second pixel and configured to apply data voltages to the first pixel and the second pixel, a first scan line crossing the data line and configured to transmit first scan signals to the first pixel and the second pixel during an initialization period, a second scan line crossing the data line and configured to transmit a second scan signal to the first pixel during a first data writing period, and a third scan line crossing the data line and configured to transmit a third scan signal delayed for a predetermined time from the first scan signal to the second pixel during a second data writing period.

The second scan signal and the third scan signal may be transmitted sequentially.

The first pixel and the second pixel may be symmetrical with respect to the data line.

The device may further include a first emission control line crossing the data line and configured to transmit emission control signals to the first pixel and the second pixel.

The device may further include a third pixel disposed in the first pixel column and in a second pixel row after the first pixel row, a fourth pixel disposed in the second pixel column and in the second pixel row, a second emission control line crossing the data line and configured to transmit the emission control signals to the third pixel and the fourth pixel, wherein the first emission control line and the second emission control line may be connected to each other.

The first scan line may correspond to a third pixel row prior to the first pixel row, and the second scan line and the third scan lines may correspond to the first pixel row.

The first data writing period and the second data writing period may sequentially follow the initialization period, and at least portions of the first data writing period and the second data writing period may overlap each other.

Another aspect is a display device comprising: a first pixel disposed in an odd numbered pixel column and in a first pixel row; a second pixel disposed in an even numbered pixel column and in the first pixel row; a data line disposed between the odd and even numbered pixel columns and configured to apply a plurality of data voltages to the first and second pixels; a first odd number scan line configured to transmit a first odd number scan signal to the first pixel during a first data writing period; a first even number scan line configured to transmit a first even number scan signal to the second pixel during a second data writing period; and a second scan line configured to transmit a second scan signal to the first and second pixels during an initialization period.

In the above device, the first odd and even number scan lines are configured to respectively transmit the first odd number scan signal and the first even number scan signal sequentially.

In the above device, the first and second pixels are symmetrical to each other with respect to the data line.

The above device further comprises an emission control line configured to transmit a plurality of emission control signals to the first and second pixels.

In the above device, the emission control line comprises a at least two emission control lines disposed in at least two pixel rows connected to each other, wherein the at least two emission control lines are configured to transmit the same emission control signal to the pixels disposed in the at least two pixel rows.

In the above device, the first odd and even number scan lines are located adjacent to the first pixel row, wherein the second scan line is located adjacent to a second pixel row formed above the first pixel row.

In the above device, the first and second data writing periods sequentially follow the initialization period, wherein at least portions of the first and second data writing periods overlap each other.

In the above device, each of the first and second pixels comprises: an organic light-emitting diode (OLED); a second transistor comprising a gate electrode electrically connected to the first odd number scan line or the first even number scan line, a first electrode electrically connected to the data line, and a second electrode electrically connected to a first node; a capacitor electrically connected between a first power voltage line and a second node; a first transistor comprising a gate electrode electrically connected to the second node, a first electrode electrically connected to the first node, and a second electrode electrically connected to a third node; a third transistor comprising a gate electrode electrically connected to the first odd number scan line or the first even number scan line, a first electrode electrically connected to the third node, and a second electrode electrically connected to the second node; a fourth transistor comprising a gate electrode electrically connected to the second scan line, a first electrode electrically connected to an initialization voltage line, and a second electrode electrically connected to the second node; a fifth transistor comprising a gate electrode electrically connected to an emission control line, a first electrode electrically connected to the first power voltage line, and a second electrode electrically connected to the first node; a sixth transistor comprising a gate electrode electrically connected to the emission control line, a first electrode electrically connected to the third node, and a second electrode electrically connected to an anode of the OLED; and a seventh transistor comprising a gate electrode electrically connected to the second scan line, a first electrode electrically connected to the initialization voltage line, and a second electrode electrically connected to the anode of the OLED.

In the above device, when the second scan signal has a gate-on voltage, the fourth and seventh transistors are configured to be turned on and apply an initialization voltage to at least one of the gate electrode of the first transistor and the anode of the OLED.

In the above device, when the first odd number scan signal or the first even number scan signal has a gate-on voltage, the second and third transistors are configured to be turned on and apply a compensated voltage to the gate electrode of the first transistor and both ends of the capacitor, wherein the compensated voltage is substantially equal to the combination of a selected data voltage and a threshold voltage of the first transistor.

In the above device, at least a portion of a first data writing period when the first odd number scan signal has a gate-on voltage and at least a portion of the second writing period when the first even number scan signal has a gate-on voltage overlap each other.

In the above device, the emission control line is configured to transmit a plurality of emission control signals to the first and second pixels, wherein, when the emission control signal has a gate-on voltage, the fifth and sixth transistors are configured to be turned on so that a current corresponding to the voltage difference between a voltage applied to the gate electrode of the first transistor and a first power voltage is supplied to the OLED.

In the above device, the emission control line includes at least two emission control lines disposed in at least two pixel rows connected to each other, wherein the at least two emission control lines are configured to transmit the same emission control signal to the pixels disposed in the at least two pixel rows.

Another aspect is a display device comprising: a first pixel disposed in a first pixel column and in a first pixel row; a second pixel disposed in a second pixel column adjacent to the first pixel column and in the first pixel row; a data line disposed between the first and second pixels and configured to apply a plurality of data voltages to the first and second pixels; a first scan line crossing the data line and configured to transmit a plurality of first scan signals to the first and second pixels during an initialization period; a second scan line crossing the data line and configured to transmit a second scan signal to the first pixel during a first data writing period; and a third scan line crossing the data line and configured to transmit a third scan signal, delayed for a predetermined time from the first scan signal, to the second pixel during a second data writing period.

In the above device, the second and third scan lines are configured to respectively transmit the second and third scan signals sequentially.

In the above device, the first and second pixels are symmetrical to each other with respect to the data line.

The above device further comprises a first emission control line crossing the data line and configured to transmit a plurality of emission control signals to the first and second pixels.

The above device further comprises: a third pixel disposed in the first pixel column and in a second pixel row after the first pixel row; a fourth pixel disposed in the second pixel column and in the second pixel row; a second emission control line crossing the data line and configured to transmit the emission control signals to the third and fourth pixels, wherein the first and second emission control lines are connected to each other.

In the above device, the first scan line corresponds to a third pixel row above the first pixel row, wherein the second and third scan lines are located adjacent to the first pixel row.

In the above device, the first and second data writing periods sequentially follow the initialization period, wherein at least portions of the first and second data writing periods overlap each other.

According to at least one of the disclosed embodiments, there may be provided a display device having an increased aperture ratio of pixels and decreased manufacturing costs, and a method of driving the display device.

DETAILED DESCRIPTION OF CERTAIN INVENTIVE EMBODIMENTS

Figure 1:
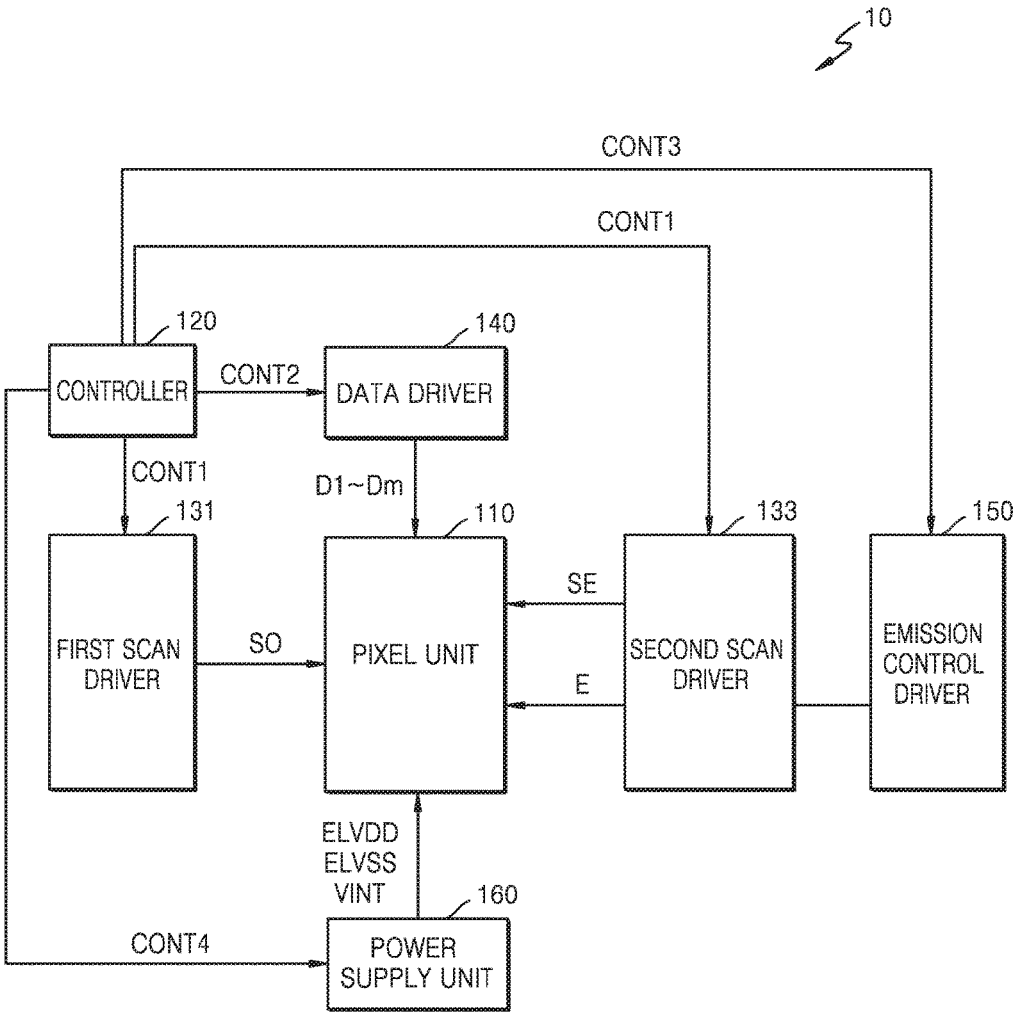
FIG. 1 is a block diagram schematically illustrating a structure of a display device according to an exemplary embodiment.

As the described technology allows for various changes and numerous embodiments, exemplary embodiments will be illustrated in the drawings and described in detail in the written description. Advantages and features of one or more exemplary embodiments and methods of accomplishing the same may be understood more readily by reference to the following detailed description of the one or more exemplary embodiments and the accompanying drawings. The described technology may, however, be embodied in many different forms and should not be construed as being limited to the one or more exemplary embodiments set forth herein.

Reference will now be made in detail to exemplary embodiments, examples of which are illustrated in the accompanying drawings Like reference numerals in the drawings denote like elements, and thus, a repeated description thereof is omitted.

In the following embodiments, the terms "first" and "second" are for differentiating one element from another element, and these elements should not be limited by these terms. In the following embodiments, the singular forms "a", "an" and "the" are intended to include the plural forms as well, unless the context clearly indicates otherwise.

In the following embodiments, it should be further understood that the terms "comprises", "comprising", "includes" and/or "including", when used herein, specify the presence of stated features or elements, but do not preclude the presence or addition of one or more other features or elements. As used herein, the term "and/or" includes any and all combinations of one or more of the associated listed items. In this disclosure, the term "substantially" includes the meanings of completely, almost completely or to any significant degree under some applications and in accordance with those skilled in the art. Moreover, "formed, disposed or positioned over" can also mean "formed, disposed or positioned on." The term "connected" includes an electrical connection.

FIG. 1 is a block diagram schematically illustrating a structure of a display device 10 according to an exemplary embodiment. Depending on embodiments, certain elements may be removed from or additional elements may be added to the display device 10 illustrated in FIG. 1. Furthermore, two or more elements may be combined into a single element, or a single element may be realized as multiple elements. This also applies to the remaining disclosed embodiments.

Referring to FIG. 1, the display device 10 includes a pixel unit 110, a controller 120, a first scan driver 131, a second scan driver 133, a data driver 140, an emission control driver 150, and a power supply unit 160. The display device 10 may be an organic light-emitting diode (OLED) display.

The pixel unit 110 may include a plurality of scan lines, a plurality of data lines, a plurality of emission control lines, a power voltage line, and a plurality of pixels. The scan lines may be regularly spaced apart from each other and arranged in pixel rows and respectively transmit scan signals SO and SE. The data lines may be regularly spaced apart from each other and arranged in pixel columns and respectively transmit data signals D1 through Dm. The scan lines and the data lines are arranged in a matrix form, and the pixels are formed in portions where the scan lines and the data lines intersect one another. Each of the emission control lines transmits an emission control signal E. The power voltage line may include an initialization voltage line transmitting an initialization voltage VINT and a first power voltage line transmitting a first power voltage ELVDD. The power voltage line may be in a grid or mesh form.

The controller 120 receives input image data and an input control signal controlling display of the input image data from an external graphic controller (not shown). Examples of the input control signal include a vertical synchronization signal, a horizontal synchronization signal, and a main clock. According to the vertical synchronization signal, the horizontal synchronization signal, and the main clock, the controller 120 generates a data signal and first to fourth control signals CONT1, CONT2, CONT3, and CONT4. Each of the first to fourth control signals CONT1, CONT2, CONT3, and CONT4 may include one or more control signals. For example, the first control signal CONT1 includes signals such as a scan start signal for instructing a scan start, a plurality of scan clock signals, and a frequency control signal. The controller 120 generates the first control signal CONT1 and transmits the first control signal CONT1 to the first scan driver 131 and the second scan driver 133. The controller 120 transmits the data signal and the second control signal CONT2 to the data driver 140. The controller 120 generates the third control signal CONT3 and transmits the third control signal CONT3 to the emission control driver 150. The controller 120 generates the fourth control signal CONT4 and transmits the fourth control signal CONT4 to the power supply unit 160.

The first scan driver 131 may be connected to a plurality of odd number scan lines of the pixel unit 110, and the second scan driver 133 may be connected to a plurality of even number scan lines of the pixel unit 110. In an exemplary embodiment which will be described later with reference to FIGS. 2 and 3, the first scan driver 131 transmits first and second odd number scan signals to pixels in an odd number column included in the pixel unit 110, and transmits first and second even number scan signals to pixels in an even number column. In exemplary embodiments which will be described later with reference to FIGS. 4 to 7, the first scan driver 131 transmits first and second odd number scan signals to pixels in an odd number column included in the pixel unit 110, and transmits one of the first and second odd number scan signals and a first even number scan signal to pixels in an even number column. According to the first control signal CONT1, the first scan driver 131 and the second scan driver 133 respectively apply the scan signals SO and SE formed as combinations of a gate-on voltage and a gate-off voltage to a plurality of odd number scan lines and a plurality of even number scan lines by using an interlace scanning method. For example, when the first scan driver 131 generates a first odd number scan signal and applies the first odd number scan signal to a first pixel row of the pixel unit 110, the second scan driver 133 generates a first even number scan signal and may apply the first even number scan signal to the first pixel row of the pixel unit 110. When the second scan driver 133 generates the first even number scan signal and applies the first even number scan signal to the pixel unit 110, the first scan driver 131 may generate a second odd number scan signal and may apply the second odd number scan signal to the pixel unit 110. When the scan signals SO and SE have a gate-on voltage, switching transistors of pixels that are connected to scan lines corresponding to the scan signals SO and SE having a gate-on voltage are turned on.

The data driver 140 is connected to the data lines of the pixel unit 110, and applies the data signals D1 through Dm, which denote gradation, to the data lines according to the second control signal CONT2. The data driver 140 converts input image data having gradation into a data signal in the form of voltage or current.

According to the third control signal CONT3, the emission control driver 150 generates the emission control signal E formed as a combination of a gate-on voltage and a gate-off voltage and sequentially applies the emission control signal E to the emission control lines of the pixel unit 110. Although the emission control driver 150 generates the emission control signal E and applies the emission control signal E to the pixel unit 110 in the present exemplary embodiment, exemplary embodiments are not limited thereto. For example, the emission control driver 150 may be omitted, and the first scan driver 131 and/or the second scan driver 133 may generate the emission control signal E and may apply the emission control signal E to the pixel unit 110. In exemplary embodiments which will be described later with reference to FIGS. 2 to 5, the emission control driver 150 sequentially transmits an emission control signal to the pixel unit 110 in units of a pixel row. In an exemplary embodiment which will be described later with reference to FIGS. 6 and 7, the emission control driver 150 sequentially transmits the emission control signal to the pixel unit 110 in units of at least two pixel rows.

The power supply unit 160 generates the initialization voltage VINT, the first power voltage ELVDD, and a second power voltage ELVSS. The power supply unit 160 applies the generated initialization voltage VINT, first power voltage ELVDD, and second power voltage ELVSS to the pixel unit 110 according to the fourth control signal CONT4. A voltage level of the first power voltage ELVDD is higher than that of the second power voltage ELVSS. According to the fourth control signal CONT4, the power supply unit 160 generates the initialization voltage VINT and applies the initialization voltage VINT to the pixel unit 110. Although not illustrated in FIG. 1, the initialization voltage VINT may be generated by a separate initialization voltage supply unit and applied to the pixel unit 110.

Figure 2:
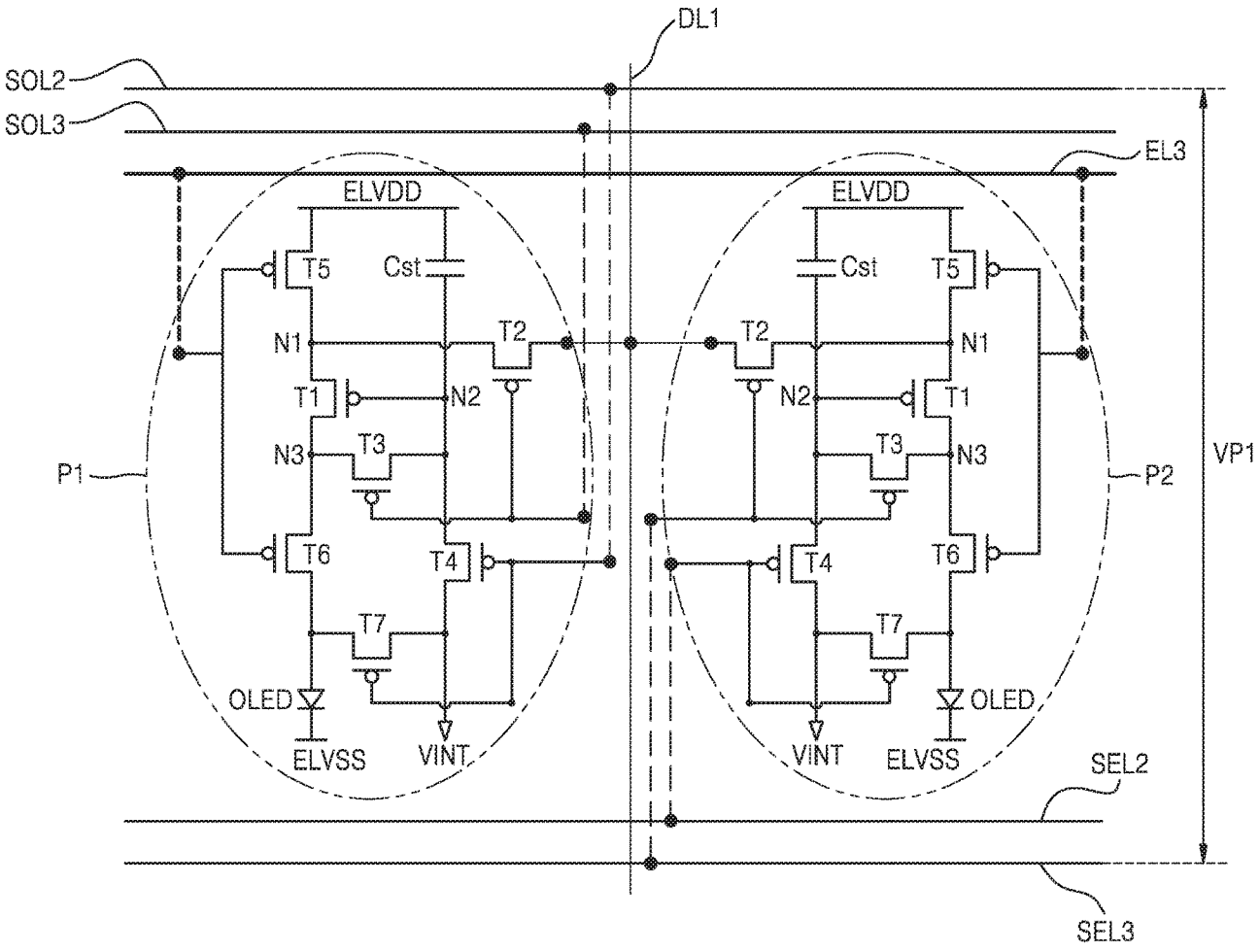
FIG. 2 is an equivalent circuit diagram of pixels of a display device, according to an exemplary embodiment.

FIG. 2 is an equivalent circuit diagram of pixels of a display device according to an exemplary embodiment.

In the exemplary embodiment of FIG. 2, for convenience of explanation, a first pixel P1 and a second pixel P2, which are disposed adjacent to each other in the same pixel row, are described as an example. The first pixel P1 may be located in an odd number pixel column, and the second pixel P2 may be located in an even number pixel column. The first pixel P1 and the second pixel P2 illustrated in FIG. 2 may be alternately disposed in a pixel row direction. In this regard, pixels may be disposed in the order of R, G, and B in the pixel row direction.

In FIG. 2, for convenience of explanation, the first pixel P1 located in a first pixel column and a third pixel row and the second pixel P2 located in a second pixel column and the third pixel row are illustrated as an example. Descriptions of FIG. 2 may apply to pixels in other pixel rows and pixel columns.

The first pixel P1, which is located in the first pixel column and the third pixel row, is connected to a third odd number scan line SOL3 corresponding to the third pixel row and a second odd number scan line SOL2 corresponding to a second pixel row prior to the third pixel row respectively.

The second pixel P2, which is located in the second pixel column and the third pixel row, is respectively connected to a third even number scan line SEL3 corresponding to the third pixel row and a second even number scan line SEL2 corresponding to the second pixel row prior to the third pixel row.

A first data line DL1 is disposed between the first pixel column and the second pixel column and transmits the first data signal D1 to the first pixel P1 and the second pixel P2.

As illustrated in FIG. 2, the odd number scan lines SOL2 and SOL3 are located above the first pixel P1 and the second pixel P2, and the even number scan lines SEL2 and SEL3 are located below the first pixel P1 and the second pixel P2. In this regard, the third odd number scan line SOL3 may be closer to the first pixel P1 and the second pixel P2 than the second odd number scan line SOL2 is, or the second even number scan line SEL2 may be closer to the first pixel P1 and the second pixel P2 than the third even number scan line SEL3 is. However, exemplary embodiments are not limited thereto. For example, the location of the odd number scan lines SOL2 and SOL3 and the location of the even number scan lines SEL2 and SEL3 may be swapped, locations of the odd number scan lines SOL2 and SOL3 and the even number scan lines SEL2 and SEL3 may be swapped, or all of the odd number scan lines SOL2 and SOL3 and the even number scan lines SEL2 and SEL3 may be located above or below the first pixel P1 and the second pixel P2.

A vertical pitch of a pixel may refer to a length in a pixel column direction of an area including the pixel and scan lines supplying scan signals to the pixel. For example, a vertical pitch VP1 of each of the first and second pixels P1 and P2 illustrated in FIG. 2 is the distance between the second odd number scan line SOL2 and the third even number scan line SEL3.

Each of the first pixel P1 and the second pixel P2 includes first to seventh transistors T1 to T7, a capacitor Cst, and a light-emitting device. The light-emitting device may be an OLED. Devices included in the first pixel P1 and devices included in the second pixel P2 may be symmetrical with respect to the first data line DL1.

The first pixel P1 is connected to the third odd number scan line SOL3 transmitting a third odd number scan signal SO3 (refer to FIG. 3) to the second transistor T2 and the third transistor T3, the second odd number scan line SOL2 transmitting a second odd number scan signal SO2 (refer to FIG. 3) to the fourth transistor T4 and the seventh transistor T7, a third emission control line EL3 transmitting a third emission control signal E3 (refer to FIG. 3) to the fifth transistor T5 and the sixth transistor T6, and the first data line DL1 transmitting the first data signal D1. Also, the first pixel P1 is connected to the first power voltage line transmitting the first power voltage ELVDD and the initialization voltage line transmitting the initialization voltage VINT for initializing voltages of a gate electrode of the first transistor T1 and an anode of the OLED.

The first transistor T1 includes a gate electrode connected to a first electrode of the capacitor Cst, a first electrode connected to a first node N1, and a second electrode connected to a third node N3. The first transistor T1 serves as a driving transistor. The first transistor T1 receives the first data signal D1 according to a switching operation of the second transistor T2, and thus, supplies current to the OLED.

The second transistor T2 includes a gate electrode connected to the third odd number scan line SOL3, a first electrode connected to the first data line DL1, and a second electrode connected to the first electrode of the first transistor T1 at the first node N1. The second transistor T2 is turned on according to the third odd number scan signal SO3 received through the third odd number scan line SOL3, and thus, performs a switching operation for transmitting the first data signal D1 transmitted from the first data line DL1 to the first electrode of the first transistor T1.

The third transistor T3 includes a gate electrode connected to the third odd number scan line SOL3, a first electrode connected to the second electrode of the first transistor T1 at the third node N3, and a second electrode which is connected to the first electrode of the capacitor Cst, a second electrode of the fourth transistor T4, and the gate electrode of the first transistor T1 at a second node N2. The third transistor T3 is turned on according to the third odd number scan signal SO3 received through the third odd number scan line SOL3, and thus, diode-connects the first transistor T1.

The fourth transistor T4 includes a gate electrode connected to the second odd number scan line SOL2, a first electrode connected to the initialization voltage line, and the second electrode which is connected to the first electrode of the capacitor Cst, the second electrode of the third transistor T3, and the gate electrode of the first transistor T1 at the second node N2. The fourth transistor T4 is turned on according to the second odd number scan signal SO2 received through the second odd number scan line SOL2, and thus, performs an initialization operation for initializing the voltage of the gate electrode of the first transistor T1 by transmitting the initialization voltage VINT to the gate electrode of the first transistor T1.

The fifth transistor T5 includes a gate electrode connected to the third emission control line EL3, a first electrode connected to the first power voltage line, and a second electrode connected to the first electrode of the first transistor T1 and the second electrode of the second transistor T2 at the first node N1.

The sixth transistor T6 includes a gate electrode connected to the third emission control line EL3, a first electrode connected to the second electrode of the first transistor T1 and the first electrode of the third transistor T3 at the third node N3, and a second electrode connected to the anode of the OLED. When the fifth transistor T5 and the sixth transistor T6 are substantially simultaneously (or concurrently) turned on according to the third emission control signal E3 received through the third emission control line EL3, the first power voltage ELVDD is transmitted to the OLED, and thus, current flows through the OLED.

The seventh transistor T7 includes a gate electrode connected to the second odd number scan line SOL2, a first electrode connected to the second electrode of the sixth transistor T6 and the anode of the OLED, and a second electrode connected to the initialization voltage line. The seventh transistor T7 is turned on according to the second odd number scan signal SO2 received through the second odd number scan line SOL2, and thus, performs an initialization operation for initializing the voltage of the anode of the OLED by transmitting the initialization voltage VINT to the anode of the OLED.

The capacitor Cst includes the first electrode which is connected to the gate electrode of the first transistor T1, the second electrode of the third transistor T3, and the second electrode of the fourth transistor T4 at the second node N2, and a second electrode connected to the first power voltage line.

A cathode of the OLED receives the second power voltage ELVSS. The OLED receives current from the first transistor T1, and thus, emits light, thereby displaying an image.

The first pixel P1 performs initialization, data writing, and emission operations during one frame.

During an initialization period, the first pixel P1 receives the second odd number scan signal SO2 having a gate-on voltage (low level) through the second odd number scan line SOL2 and, in response to the second odd number scan signal SO2, the fourth transistor T4 and the seventh transistor T7 are turned on. The initialization voltage VINT is transmitted to the gate electrode of the first transistor T1 through the fourth transistor T4, and thus, the gate electrode of the first transistor T1 is initialized. In addition, the initialization voltage VINT is transmitted to the anode of the OLED through the seventh transistor T7, and thus, the voltage of the anode of the OLED is initialized. In exemplary embodiments, the initialization period refers to a period for which a pixel receives a scan signal having a gate-on voltage for performing the initialization operation.

During a first data writing period, the first pixel P1 receives the third odd number scan signal SO3 having a gate-on voltage (low level) through the third odd number scan line SOL3 and, in response to the third odd number scan signal SO3, the second transistor T2 and the third transistor T3 are turned on. The first data signal D1 supplied from the first data line DL1 is transmitted to the first node N1 through the second transistor T2. The first transistor T1 is diode-connected by the turned-on third transistor T3 and thus biased in a forward direction, and a compensation voltage DATA+Vth (where Vth is a negative value) obtained by subtracting a threshold voltage Vth of the first transistor T1 from a data voltage DATA applied to the first node N1 by the first data signal D1 is applied to the gate electrode of the first transistor T1. The first power voltage ELVDD and the compensation voltage DATA+Vth are applied to both terminals of the capacitor Cst, and an electric charge corresponding to a difference between voltages of the two terminals is stored in the capacitor Cst. In exemplary embodiments, a data writing period refers to a period for which a pixel receives a scan signal having a gate-on voltage for performing the data writing operation.

During a light-emitting period, the third emission control signal E3 supplied from the third emission control line EL3 is changed from a gate-off voltage (high level) to a gate-on voltage (low level). Then, the fifth transistor T5 and the sixth transistor T6 are turned on by the low-level third emission control signal E3. Thus, a current according to a voltage difference between the voltage of the gate electrode of the first transistor T1 and the first power voltage ELVDD occurs, and the current is supplied to the OLED through the sixth transistor T6. During the light-emitting period, a gate-source voltage Vgs of the first transistor T1 is maintained at '(DATA+Vth)-ELVDD' by the capacitor Cst. Also, according to current-voltage relationship of the first transistor T1, current is proportional to the square of a value obtained by subtracting a threshold voltage from a gate-source voltage, '$(DATA-ELVDD)^2$.' Accordingly, the current is determined regardless of the threshold voltage Vth of the first transistor T1. In exemplary embodiments, the light-emitting period may refer to a period for which a pixel receives a scan signal having a gate-on voltage for performing the emission operation.

The second pixel P2 will be described hereinafter, and a description of the second pixel P2 that is the same as the above description of the first pixel P1 will be omitted or briefly mentioned.

The second pixel P2 is connected to the third even number scan line SEL3 transmitting a third even number scan signal SE3 (refer to FIG. 3) to the second transistor T2 and the third transistor T3, the second even number scan line SEL2 transmitting a second even number scan signal SE2 (refer to FIG. 3) to the fourth transistor T4 and the seventh transistor T7, the third emission control line EL3 transmitting the third emission control signal E3 to the fifth transistor T5 and the sixth transistor T6, and the first data line DL1 transmitting the first data signal D1.

The second transistor T2 includes a gate electrode connected to the third even number scan line SEL3. The second transistor T2 is turned on according to the third even number scan signal SE3 received through the third even number scan line SEL3, and thus, performs a switching operation for transmitting the first data signal D1 transmitted via the first data line DL1 to a first electrode of the first transistor T1.

The third transistor T3 includes a gate electrode connected to the third even number scan line SEL3. The third transistor T3 is turned on according to the third even number scan signal SE3 received through the third even number scan line SEL3, and thus, diode-connects the first transistor T1.

The fourth transistor T4 includes a gate electrode connected to the second even number scan line SEL2. The fourth transistor T4 is turned on according to the second even number scan signal SE2 received through the second even number scan line SEL2, and thus, performs an initialization operation for initializing a voltage of a gate electrode of the first transistor T1 by transmitting the initialization voltage VINT to the gate electrode of the first transistor T1.

The seventh transistor T7 includes a gate electrode connected to the second even number scan line SEL2. The seventh transistor T7 is turned on according to the second even number scan signal SE2 received through the second even number scan line SEL2, and thus, performs an initialization operation for initializing a voltage of an anode of the OLED by transmitting the initialization voltage VINT to the anode of the OLED.

The second pixel P2 performs initialization, data writing, and emission operations during one frame.

During an initialization period, the second pixel P2 receives the second even number scan signal SE2 having a gate-on voltage (low level) through the second even number scan line SEL2. In response to the second even number scan signal SE2, the fourth transistor T4 and the seventh transistor T7 are turned on.

During a second data writing period, the second pixel P2 receives the third even number scan signal SE3 having a gate-on voltage (low level) through the third even number scan line SEL3. In response to the third even number scan signal SE3, the second transistor T2 and the third transistor T3 are turned on.

During a light-emitting period, the second pixel P2 receives the third emission control signal E3 having a gate-on voltage (low level) through the third emission control line EL3. In response to the third emission control signal E3, the fifth transistor T5 and the sixth transistor T6 are turned on.

As such, according to an exemplary embodiment, the first pixel P1 and the second pixel P2 may be located in different pixel columns respectively, and may share the same data line and thus receive data signals respectively through the same data line. Also, the first pixel P1 and the second pixel P2 may be located in the same pixel row, and may receive scan signals through different scan lines respectively.

Figure 3:
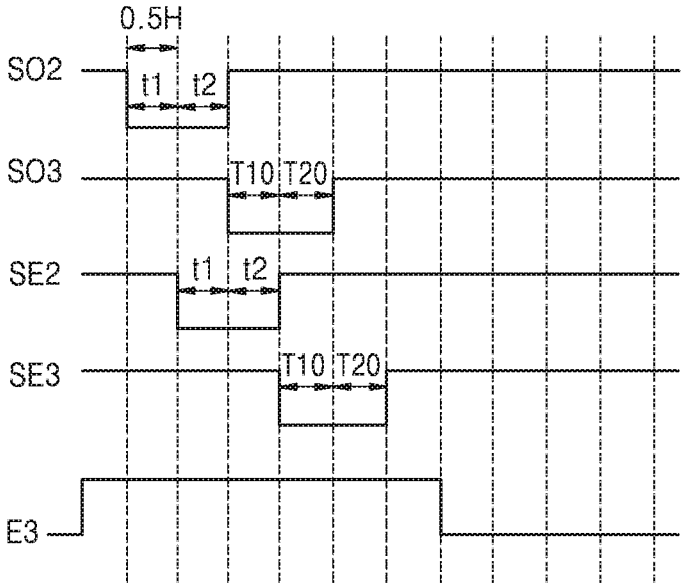
FIG. 3 is a timing diagram for describing driving of a display device, according to an exemplary embodiment.

FIG. 3 is a timing diagram for describing driving of a display device, according to an exemplary embodiment. FIG. 3 is an example of the pixel unit 110 of FIG. 1 which includes the first pixel P1 and the second pixel P2 of FIG. 2.

The second odd number scan line SOL2 transmits the second odd number scan signal SO2 to the first pixel P1 during a first initialization period. The second even number scan line SEL2 transmits the second even number scan signal SE2 to the second pixel P2 during a second initialization period.

The third odd number scan line SOL3 transmits the third odd number scan signal SO3 to the first pixel P1 during a first data writing period. The third even number scan line SEL3 transmits the third even number scan signal SE3 to the second pixel P2 during a second data writing period.

The third emission control line EL3 transmits the third emission control signal E3 to the first pixel P1 and the second pixel P2 during a light-emitting period.

The second odd number scan signal SO2 and the second even number scan signal SE2 are applied at a low level for a predetermined time (for example, 1 horizontal time period (1H)) during the first initialization period and the second initialization period, respectively. The third odd number scan signal SO3 and the third even number scan signal SE3 are applied at a low level for a predetermined time (for example, 1 horizontal time period (1H)) during the first data writing period and the second data writing period, respectively. In this regard, the second odd number scan signal SO2 and the second even number scan signal SE2 overlap each other for a 0.5 horizontal time period (0.5H), and the third odd number scan signal SO3 and the third even number scan signal SE3 overlap each other as much as 0.5 horizontal time (0.5H). The initialization periods may be divided into a first sub-period t1 and a second sub-period t2. The first and second data writing periods may be divided into a first sub-period T10 and a second sub-period T20. The first sub-period T10 may be a data pre-charge period, and the second sub-period T20 may be a data programming period.

During the initialization period of the first pixel P1, the second odd number scan signal SO2 may be applied at a low level to the first pixel P1 through the second odd number scan line SOL2, and during the first data writing period of the first pixel P1, the third odd number scan signal SO3 may be applied at a low level to the first pixel P1 through the third odd number scan line SOL3. The third odd number scan signal SO3 may be applied at a low level after the initialization period of the first pixel P1 ends.

During the initialization period of the second pixel P2, the second even number scan signal SE2 may be applied at a low level to the second pixel P2 through the second even number scan line SEL2, and during the second data writing period of the second pixel P2, the third even number scan signal SE3 may be applied at a low level to the second pixel P2 through the third even number scan line SEL3. The third even number scan signal SE3 may be applied at a low level after the initialization period of the second pixel P2 ends.

The second odd number scan signal SO2 may be applied at a low level and then, the second even number scan signal SE2 may be applied at a low level. In this regard, portions of the second odd number scan signal SO2 and the second even number scan signal SE2 may overlap each other. For example, the second sub-period t2 of the second odd number scan signal SO2 and the first sub-period t1 of the second even number scan signal SE2 may overlap each other.

The third odd number scan signal SO3 may be applied at a low level and then, the third even number scan signal SE3 may be applied at a low level. In this regard, portions of the third odd number scan signal SO3 and the third even number scan signal SE3 may overlap each other. For example, the second sub-period T20, which is a data programming period of the third odd number scan signal SO3, and the first sub-period T10, which is a data pre-charge period of the third even number scan signal SE3, may overlap each other.

During the light-emitting periods of the first pixel P1 and the second pixel P2, the third emission control signal E3 may be applied at a low level to the first pixel P1 and the second pixel P2 through the third emission control line EL3. In this regard, the third emission control signal E3 may be applied at a high level during the first and second initialization periods and the first and second data writing periods for which the second odd number scan signal SO2, the third odd number scan signal SO3, the second even number scan signal SE2, and the third even number scan signal SE3 are respectively applied at a low level, and may be applied at a low level after the first and second data writing periods end. For example, the third emission control signal E3 may be applied at a low level after the period for which the third even number scan signal SE3 is applied at a low level ends and 0.5 horizontal time (0.5H) passes. The third emission control signal E3 may be applied at a low level for more than a predetermined time (for example, 1 horizontal time (1H)).

According to an exemplary embodiment, at least one pixel (not shown) disposed in a pixel row different from the third pixel row in which the first pixel P1 and the second pixel P2 are located, for example, a fourth pixel row, receives a fourth emission control signal different from the third emission control signal E3 through an emission control line different from the third emission control line EL3, for example, a fourth emission control line. The fourth emission control signal may be a signal delayed for a predetermined time from the third emission control signal E3.

Hereinafter, a display device and a method of driving the same, according to another exemplary embodiment will be described with reference to FIGS. 4 and 5. Descriptions of FIGS. 4 and 5 that are the same as the above descriptions of FIGS. 2 and 3 will be omitted below.

Figure 4:
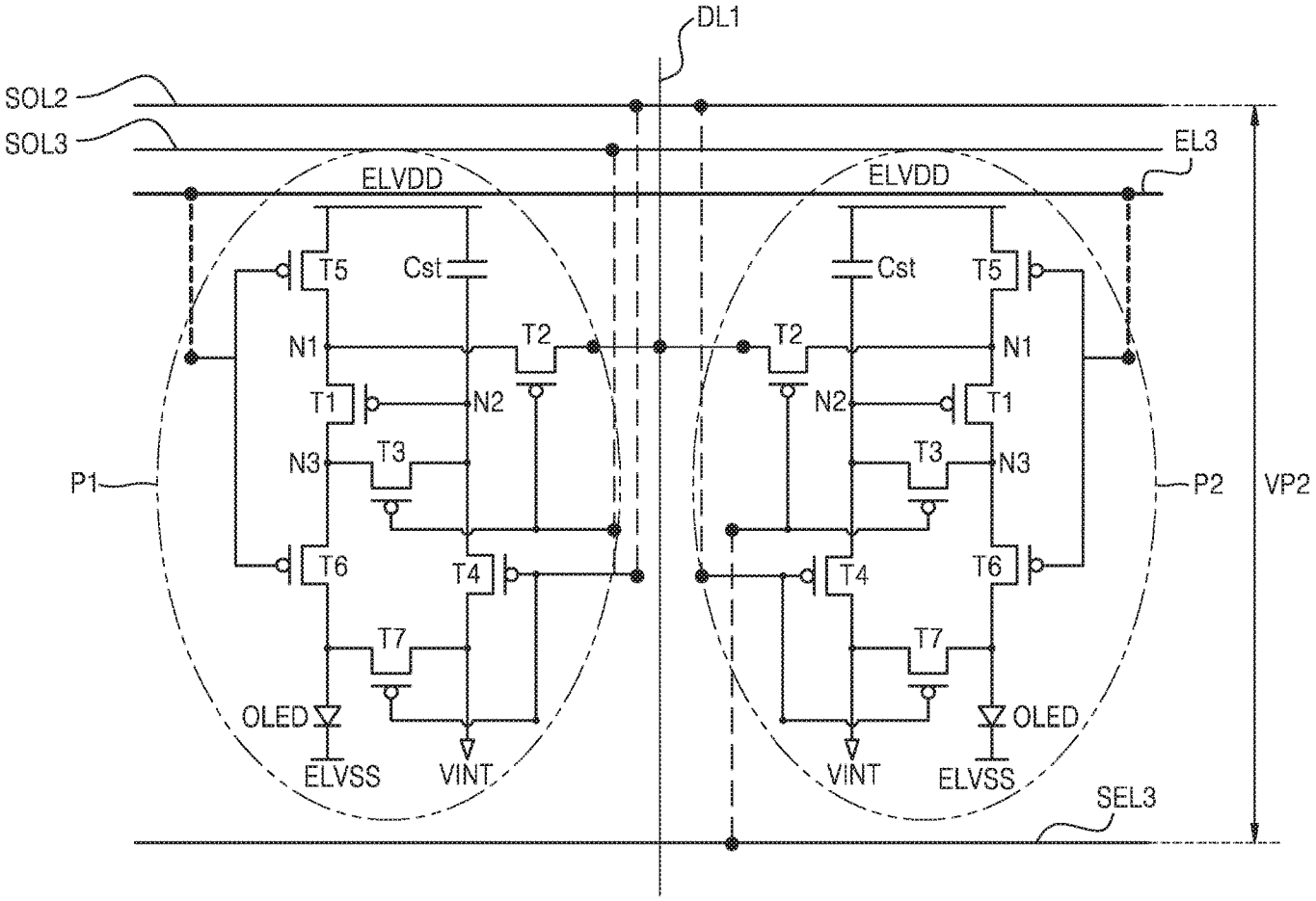
FIG. 4 is an equivalent circuit diagram of pixels of a display device, according to another exemplary embodiment.

FIG. 4 is an equivalent circuit diagram of pixels of a display device according to another exemplary embodiment.

In FIG. 4, for convenience of explanation, the first pixel P1 located in a first pixel column and a third pixel row and the second pixel P2 located in a second pixel column and the third pixel row are illustrated as an example. Descriptions of FIG. 4 may be applied the same to pixels in other pixel rows and pixel columns.

Referring to FIG. 4, the first pixel P1, which is a pixel located in the first pixel column and the third pixel row, is connected to the third odd number scan line SOL3 corresponding to the third pixel row and the second odd number scan line SOL2 corresponding to a second pixel row prior to the third pixel row. The second pixel P2, which is a pixel located in the second pixel column and the third pixel row, is connected to the third even number scan line SEL3 corresponding to the third pixel row and the second odd number scan line SOL2 corresponding to the second pixel row prior to the third pixel row respectively.

As illustrated in FIG. 4, the odd number scan lines SOL2 and SOL3 may be located above the first pixel P1 and the second pixel P2, and the even number scan line SEL3 may be located below the first pixel P1 and the second pixel P2. In this regard, the third odd number scan line SOL3 may be closer to the first pixel P1 and the second pixel P2 than the second odd number scan line SOL2 is. However, exemplary embodiments are not limited thereto. For example, the location of the odd number scan lines SOL2 and the location of SOL3 may be swapped, locations of the odd number scan lines SOL2 and SOL3 and the even number scan line SEL3 may be swapped, or all of the odd number scan lines SOL2 and SOL3 and the even number scan line SEL3 may be located above or below the first pixel P1 and the second pixel P2. A vertical pitch VP2 of each of the first and second pixels P1 and P2 illustrated in FIG. 4 may be the distance between the second odd number scan line SOL2 and the third even number scan line SEL3.

Figure 5:
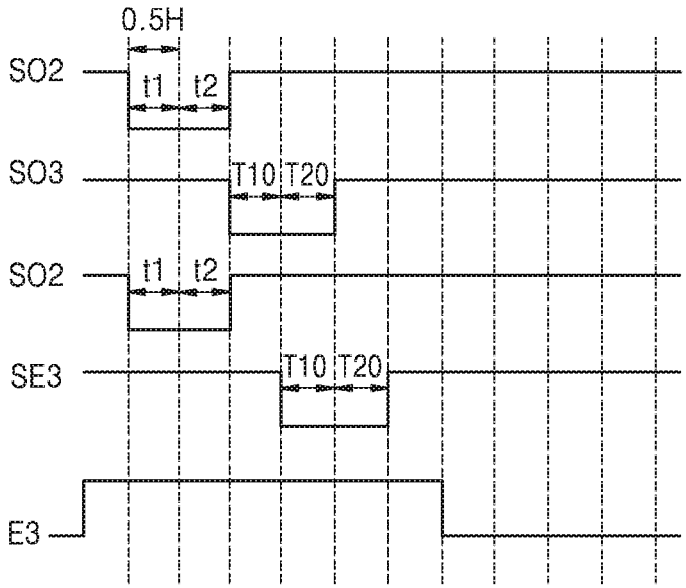
FIG. 5 is a timing diagram for describing driving of a display device, according to another exemplary embodiment.

The second transistor T2 and the third transistor T3 of the first pixel P1 are connected to the third odd number scan line SOL3 transmitting the third odd number scan signal SO3 (refer to FIG. 5). The fourth transistor T4 and the seventh transistor T7 of the first pixel P1 are connected to the second odd number scan line SOL2 transmitting the second odd number scan signal SO2 (refer to FIG. 5).

The second transistor T2 and the third transistor T3 of the second pixel P2 are connected to the third even number scan line SEL3 transmitting the third even number scan signal SE3 (refer to FIG. 5). The fourth transistor T4 and the seventh transistor T7 of the second pixel P2 are connected to the second odd number scan line SOL2 transmitting the second odd number scan signal SO2.

The fourth transistor T4 of the second pixel P2 includes a gate electrode connected to the second odd number scan line SOL2. The fourth transistor T4 of the second pixel P2 is turned on according to the second odd number scan signal SO2 received through the second odd number scan line SOL2, and thus, performs an initialization operation for initializing a voltage of a gate electrode of the first transistor T1 by transmitting the initialization voltage VINT to the gate electrode of the first transistor T1.

The seventh transistor T7 of the second pixel P2 includes a gate electrode connected to the second odd number scan line SOL2. The seventh transistor T7 of the second pixel P2 is turned on according to the second odd number scan signal SO2 received through the second odd number scan line SOL2, and thus, performs an initialization operation for initializing a voltage of an anode of the OLED by transmitting the initialization voltage VINT to the anode of the OLED.

During an initialization period, the second pixel P2 receives the second odd number scan signal SO2 having a gate-on voltage (low level) through the second odd number scan line SOL2, and in response to the second odd number scan signal SO2, the fourth transistor T4 and the seventh transistor T7 are turned on.

FIG. 5 is a timing diagram for describing driving of a display device, according to another exemplary embodiment. FIG. 5 is an example of a case where the pixel unit 110 of FIG. 1 includes the first pixel P1 and the second pixel P2 of FIG. 4.

The second odd number scan line SOL2 transmits the second odd number scan signal SO2 to the first pixel P1 and the second pixel P2 during an initialization period. The third odd number scan line SOL3 transmits the third odd number scan signal SO3 to the first pixel P1 during a first data writing period. The third even number scan line SEL3 transmits the third even number scan signal SE3 to the second pixel P2 during a second data writing period. The third emission control line EL3 transmits the third emission control signal E3 to the first pixel P1 and the second pixel P2 during a light-emitting period.

The second odd number scan signal SO2 is applied at a low level for a predetermined time (for example, 1 horizontal time (1H)) during the initialization period. The third odd number scan signal SO3 and the third even number scan signal SE3 are applied at a low level for a predetermined time (for example, 1 horizontal time (1H)) during the first data writing period and the second data writing period, respectively. In this regard, the third odd number scan signal SO3 and the third even number scan signal SE3 overlap each other for a 0.5 horizontal time period (0.5H). The initialization period may be divided into a first sub-period t1 and a second sub-period t2, and the first and second data writing periods may be divided into a first sub-period T10 and a second sub-period T20.

During the initialization periods of the first and second pixels P1 and P2, the second odd number scan signal SO2 may be applied at a low level to the first pixel P1 and the second pixel P2 through the second odd number scan line SOL2. During the first data writing period, the third odd number scan signal SO3 may be applied at a low level to the first pixel P1 through the third odd number scan line SOL3, and during the second data writing period, the third even number scan signal SE3 may be applied at a low level to the second pixel P2 through the third even number scan line SEL3.

According to the exemplary embodiment illustrated in FIG. 4, the first pixel P1 and the second pixel P2 disposed in the same pixel row may receive the same scan signal through the same scan line during the initialization period, and may respectively receive different scan signals through different scan lines during the data writing periods. The display device illustrated in FIG. 4 has a smaller number of scan lines included in the pixel unit 110 than the display device illustrated in FIG. 2 and thus may have wider pixel design space and decreased manufacturing costs.

Hereinafter, a display device and a method of driving the same, according to another exemplary embodiment will be described with reference to FIG. 6. A description of FIG. 6 that is the same as the above description of FIG. 4 will be omitted below. The first pixel P1 and the second pixel P2 included in a display device illustrated in FIG. 6 may be driven based on the timing diagram illustrated in FIG. 5.

Figure 6:
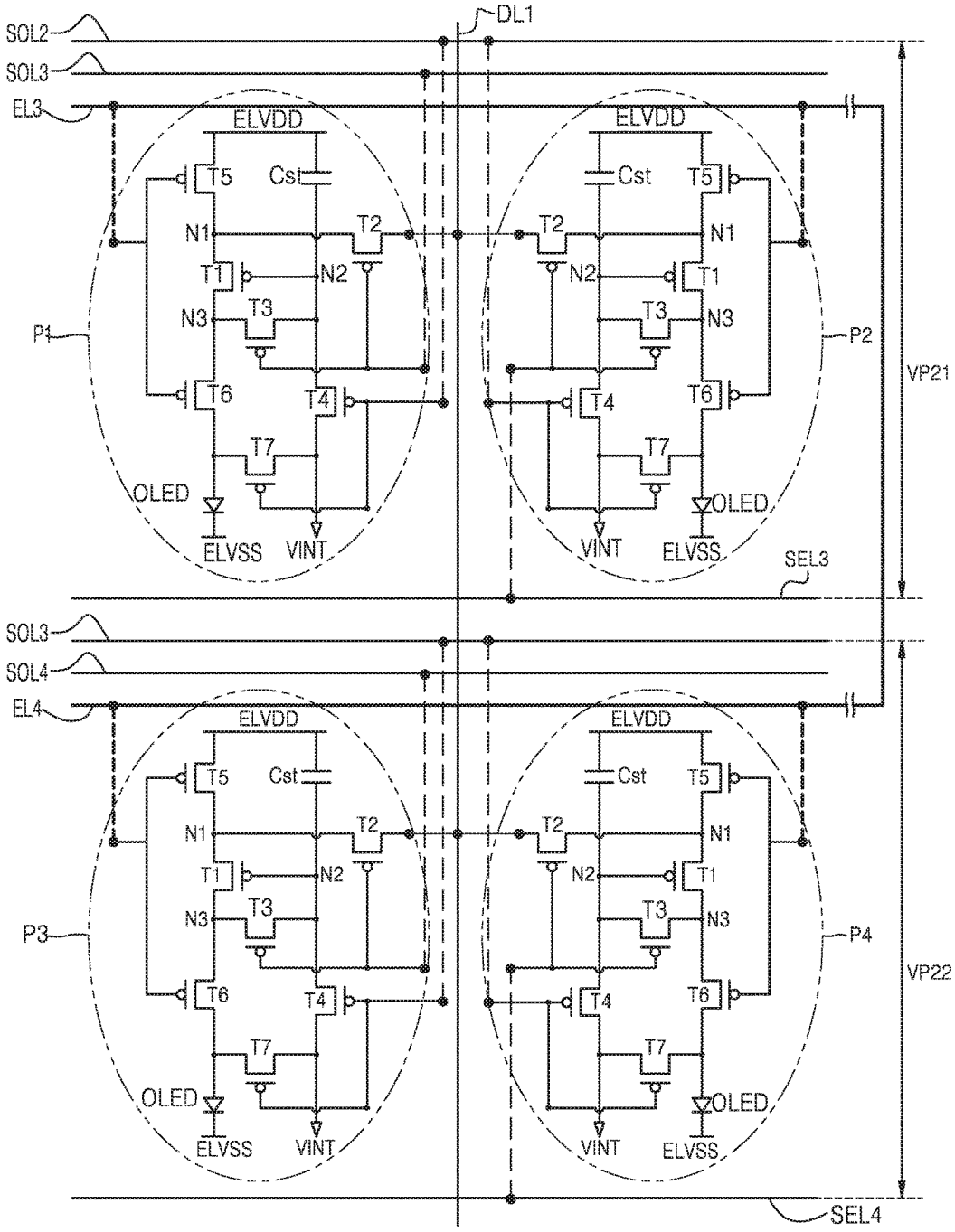
FIG. 6 is an equivalent circuit diagram of pixels of a display device, according to another exemplary embodiment.
Figure 7:
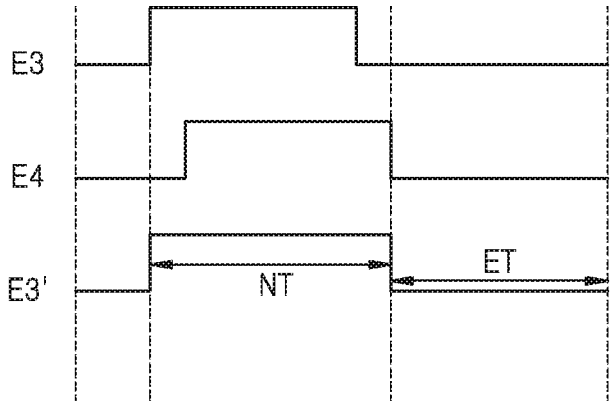
FIG. 7 illustrates timing of an emission control signal in the exemplary embodiment of FIG. 6.

FIG. 6 is an equivalent circuit diagram of pixels of a display device according to another exemplary embodiment. FIG. 7 illustrates timing of an emission control signal in the exemplary embodiment of FIG. 6.

In FIG. 6, for convenience of explanation, the first pixel P1 located in a first pixel column and a third pixel row, the second pixel P2 located in a second pixel column and the third pixel row, a third pixel P3 located in the first pixel column and a fourth pixel row, and a fourth pixel P4 located in the second pixel column and the fourth pixel row are illustrated as an example. Descriptions of FIG. 6 may be applied the same to pixels in other pixel rows and pixel columns.

Referring to FIG. 6, the third pixel P3, which is a pixel located in the first pixel column and the fourth pixel row, is connected to a fourth odd number scan line SOL4 corresponding to the fourth pixel row and the third odd number scan line SOL3 corresponding to the third pixel row prior to the fourth pixel row respectively. The fourth pixel P4, which is a pixel located in the second pixel column and the fourth pixel row, is connected to a fourth even number scan line SEL4 corresponding to the fourth pixel row and the third odd number scan line SOL3 corresponding to the third pixel row prior to the fourth pixel row respectively.

A vertical pitch VP21 of each of the first and second pixels P1 and P2 illustrated in FIG. 6 may be the distance between the second odd number scan line SOL2 and the third even number scan line SEL3. A vertical pitch VP22 of each of the third and fourth pixels P3 and P4 illustrated in FIG. 6 may be the distance between the third odd number scan line SOL3 and the fourth even number scan line SEL4.

The second transistor T2 and the third transistor T3 of the third pixel P3 are connected to the fourth odd number scan line SOL4 transmitting a fourth odd number scan signal. The fourth transistor T4 and the seventh transistor T7 of the third pixel P3 are connected to the third odd number scan line SOL3 transmitting a third odd number scan signal. The fifth transistor T5 and the sixth transistor T6 of the third pixel P3 are connected to a fourth emission control line EL4. The third pixel P3 is connected to the first data line DL1 transmitting the first data signal D1. Also, the third pixel P3 is connected to a first power voltage line transmitting the first power voltage ELVDD and an initialization voltage line transmitting the initialization voltage VINT for initializing voltages of a gate electrode of the first transistor T1 and an anode of the OLED.

In this regard, the fourth emission control line EL4 and the third emission control line EL3 are connected to each other and receive the same emission control signal E3' (refer to FIG. 7) from the emission control driver 150. In the exemplary embodiments illustrated in FIGS. 2 and 4, a third emission control line and a fourth emission control line respectively apply a third emission control signal and a fourth emission control signal at a predetermined interval. However, as illustrated in FIG. 7, in the exemplary embodiment illustrated in FIG. 6, the third emission control line EL3 and the fourth emission control line EL4 are connected to each other, and thus, a length of a high level period of the emission control signal E3' is adjusted. Accordingly, the emission control signal E3' has a non-emitting period NT (initialization period and data writing period) including a rising time corresponding to a rising time of the third emission control signal E3 and a falling time corresponding to a falling time of the fourth emission control signal E4. During the non-emitting period NT of the emission control signal E3', the fifth transistor T5 and the sixth transistor T6 are turned off, and during a light-emitting period ET of the emission control signal E3', the fifth transistor T5 and the sixth transistor T6 are turned on.

Although FIG. 6 illustrates an example in which emission control lines of two pixel rows are connected to each other, exemplary embodiments are not limited thereto. For example, emission control lines of three or more pixel rows are connected to each other, and the same emission control signal may be transmitted to pixels in the three or more pixel rows. In this case, a length of a high level period of the emission control signal may be longer.

Although different scan lines are connected to the first to seventh transistors T1 to T7, the capacitor Cst, and a light-emitting device included in the third pixel P3 and the fourth pixel P4 and the first to seventh transistors T1 to T7, the capacitor Cst, and a light-emitting device included in the first pixel P1, the pixels P1, P3, and P4 perform same operations.

The fourth pixel P4 will be described hereinafter, and a description of the fourth pixel P4 that is the same as the above description of the third pixel P3 will be omitted below.

The second transistor T2 and the third transistor T3 of the fourth pixel P4 are connected to the fourth even number scan line SEL4 transmitting a fourth even number scan signal, the fourth transistor T4 and the seventh transistor T7 of the fourth pixel P4 are connected to the third odd number scan line SOL3 transmitting a third odd number scan signal, and the fifth transistor T5 and the sixth transistor T6 of the fourth pixel P4 are connected to the fourth emission control line EL4. The fourth pixel P4 is connected to the first data line DL1 transmitting the first data signal D1.

In this regard, the fourth emission control line EL4 is connected to the third emission control line EL3, and thus, the fourth pixel P4 receives the same emission control signal E3' as the second pixel P2.

According to the exemplary embodiment illustrated in FIG. 6, emission control lines EL connected to pixels disposed in adjacent pixel rows, for example, a pair of an odd number pixel row and an even number pixel row, are connected to each other to operate based on one emission control signal. Accordingly, the display device illustrated in FIG. 6 has a smaller number of emission control signals output by the emission control driver 150 than the display devices illustrated in FIGS. 2 and 4 and thus may have the smaller emission control driver 150. Accordingly, dead space may be decreased, and thus, wider pixel design space may be obtained.

In the exemplary embodiments described herein, transistors of a pixel circuit are p-type transistors. In this regard, a gate-on voltage turning on the transistors is a low-level voltage, and a gate-off voltage turning off the transistors is a high-level voltage. However, exemplary embodiments are not limited thereto, and the transistors of a pixel circuit may be n-type transistors. In this regard, a gate-on voltage turning on the transistors is a high-level voltage, and a gate-off voltage turning off the transistors is a low-level voltage.

A transistor according to exemplary embodiments may be one of an amorphous silicon thin film transistor, a low temperature polysilicon (LTPS) thin film transistor, and an oxide thin film transistor. The oxide thin film transistor may include oxides, such as amorphous indium gallium zinc oxide (IGZO), zinc oxide (ZnO), or titanium oxide (TiO), as an active layer.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While the inventive technology been described with reference to the figures, it will be understood by those of ordinary skill in the art that various changes in form and details may be made therein without departing from the spirit and scope as defined by the following claims.

What is claimed is:

1. A display device comprising:

a first pixel disposed in an odd numbered pixel column and in a first pixel row;

a second pixel disposed in an even numbered pixel column and in the first pixel row;

a data line disposed between the odd and even numbered pixel columns and configured to apply a plurality of data voltages to the first and second pixels;

a first odd number scan line configured to transmit a first odd number scan signal only to the first pixel during a first data writing period;

a first even number scan line configured to transmit a first even number scan signal only to the second pixel during a second data writing period; and a second scan line configured to transmit a second scan signal to the first and second pixels during an initialization period, wherein each of the first and second pixels comprises:

an organic light-emitting diode (OLED);

a second transistor comprising a gate electrode electrically connected to the first odd number scan line or the first even number scan line, a first electrode electrically connected to the data line, and a second electrode electrically connected to a first node;

a capacitor electrically connected between a first power voltage line and a second node;

a first transistor comprising a gate electrode electrically connected to the second node, a first electrode electrically connected to the first node, and a second electrode electrically connected to a third node;

a third transistor comprising a gate electrode electrically connected to first odd number scan line or the first even number scan line, a first electrode electrically connected to the third node, and a second electrode electrically connected to the second node;

a fourth transistor comprising a gate electrode electrically connected to the second scan line, a first electrode electrically connected to an initialization voltage line, and a second electrode electrically connected to the second node;

a fifth transistor comprising a gate electrode electrically connected to an emission control line, a first electrode electrically connected to the first power voltage line, and a second electrode electrically connected to the first node;

a sixth transistor comprising a gate electrode electrically connected to the emission control line, a first electrode electrically connected to the third node, and a second electrode electrically connected to an anode of the OLED; and a seventh transistor comprising a gate electrode electrically connected to the second scan line, a first electrode electrically connected to an initialization voltage line, and a second electrode electrically connected to the anode of the OLED.

2. The device of claim 1, wherein the first odd and even number scan lines are configured to respectively transmit the first odd number scan signal and the first even number scan signal sequentially.

3. The device of claim 1, wherein the first and second pixels are symmetrical to each other with respect to the data line.

4. The device of claim 1, wherein the emission control line configured to transmit an emission control signal to the first and second pixels.

5. The device of claim 1, wherein the emission control line comprises at least two emission control lines disposed in at least two pixel rows connected to each other, and wherein the at least two emission control lines are configured to transmit the same emission control signal to the pixels disposed in the at least two pixel rows.

6. The device of claim 1, wherein the first odd and even number scan lines are located adjacent to the first pixel row, and wherein the second scan line is located adjacent to a second pixel row located above the first pixel row.

7. The device of claim 1, wherein the first and second data writing periods sequentially follow the initialization period, and wherein at least portions of the first and second data writing periods overlap each other.

8. The device of claim 1, wherein, when the second scan signal has a gate-on voltage, the fourth and seventh transistors are configured to be turned on and apply an initialization voltage to at least one of the gate electrode of the first transistor and the anode of the OLED.

9. The device of claim 1, wherein, when the first odd number scan signal or the first even number scan signal has a gate-on voltage, the second and third transistors are configured to be turned on and apply a compensated voltage to the gate electrode of the first transistor and both ends of the capacitor, wherein the compensated voltage is substantially equal to the combination of a selected data voltage and a threshold voltage of the first transistor.

10. The device of claim 9, wherein at least a portion of a first data writing period when the first odd number scan signal has a gate-on voltage and at least a portion of the second writing period when the first even number scan signal has a gate-on voltage overlap each other.

11. The device of claim 1, wherein the emission control line is configured to transmit an emission control signal to the first and second pixels, and wherein, when the emission control signal has a gate-on voltage, the fifth and sixth transistors are configured to be turned on so that a current corresponding to the voltage difference between a voltage applied to the gate electrode of the first transistor and a first power voltage is supplied to the OLED.

12. A display device comprising:

a first pixel disposed in a first pixel column and in a first pixel row;

a second pixel disposed in a second pixel column adjacent to the first pixel column and in the first pixel row;

a data line disposed between the first and second pixels and configured to apply a data voltages to the first and second pixels;

a first scan line crossing the data line and configured to transmit a first scan signal to the first and second pixels during an initialization period;

a second scan line crossing the data line and configured to transmit a second scan signal only to the first pixel during a first data writing period; and a third scan line crossing the data line and configured to transmit a third scan signal, delayed for a predetermined time from the first scan signal, only to the second pixel during a second data writing period, wherein each of the first and second pixels comprises:

an organic light-emitting diode (OLED);

a second transistor comprising a gate electrode electrically connected to the first odd number scan line or the first even number scan line, a first electrode electrically connected to the data line, and a second electrode electrically connected to a first node;

a capacitor electrically connected between a first power voltage line and a second node;

a first transistor comprising a gate electrode electrically connected to the second node, a first electrode electrically connected to the first node, and a second electrode electrically connected to a third node;

a third transistor comprising a gate electrode electrically connected to first odd number scan line or the first even number scan line, a first electrode electrically connected to the third node, and a second electrode electrically connected to the second node;

a fourth transistor comprising a gate electrode electrically connected to the second scan line, a first electrode electrically connected to an initialization voltage line, and a second electrode electrically connected to the second node;

a fifth transistor comprising a gate electrode electrically connected to an emission control line, a first electrode electrically connected to the first power voltage line, and a second electrode electrically connected to the first node;

a sixth transistor comprising a gate electrode electrically connected to the emission control line, a first electrode electrically connected to the third node, and a second electrode electrically connected to an anode of the OLED; and a seventh transistor comprising a gate electrode electrically connected to the second scan line, a first electrode electrically connected to an initialization voltage line, and a second electrode electrically connected to the anode of the OLED.

13. The device of claim 12, wherein the second and third scan lines are configured to respectively transmit the second and third scan signals sequentially.

14. The device of claim 12, wherein the first and second pixels are symmetrical to each other with respect to the data line.

15. The device of claim 12, further comprising:

a third pixel disposed in the first pixel column and in a second pixel row after the first pixel row;

a fourth pixel disposed in the second pixel column and in the second pixel row;

a second emission control line crossing the data line and configured to transmit the emission control signal to the third and fourth pixels, wherein the first and second emission control lines are connected to each other.

16. The device of claim 12, wherein the first scan line corresponds to a third pixel row above the first pixel row, and wherein the second and third scan lines are located adjacent to the first pixel row.

17. The device of claim 12, wherein the first and second data writing periods sequentially follow the initialization period, and wherein at least portions of the first and second data writing periods overlap each other.

* * * * *